US005296329A

United States Patent [19]

Sugiyama et al.

[11] Patent Number: 5,296,329

[45] Date of Patent: Mar. 22, 1994

[54] DIAZO HEAT-SENSITIVE RECORDING MATERIAL

[75] Inventors: Takekatsu Sugiyama; Akira Igarashi, both of Shizuoka, Japan

[73] Assignee: Fuji Photo Film Co., Ltd., Kanagawa, Japan

[21] Appl. No.: 96,845

[22] Filed: Jul. 26, 1993

Related U.S. Application Data

[63] Continuation of Ser. No. 798,586, Nov. 26, 1991, abandoned.

[30] Foreign Application Priority Data

Nov. 30, 1990 [JP] Japan ..... 2-334783

[51] Int. Cl.[5] ..... G03C 1/58; G03C 5/18

[52] U.S. Cl. ..... 430/138; 430/182; 430/151; 430/964; 430/164; 430/185; 430/351

[58] Field of Search ..... 430/182, 151, 964, 164, 430/171, 183, 185, 186, 349, 351, 353, 354, 138

[56] References Cited

U.S. PATENT DOCUMENTS 4,225,662 9/1980 Matsuda et al. ..... 430/182

4,842,979 6/1989 Ishige et al. ..... 430/151

*Primary Examiner*—Charles L. Bowers, Jr.

*Assistant Examiner*—Mark F. Huff

*Attorney, Agent, or Firm*—Sughrue, Mion, Zinn, Macpeak & Seas

[57] ABSTRACT

A diazo heat-sensitive recording material which comprises a support having thereon a heat-sensitive recording layer comprising a diazo compound, a coupling component, a basic substance, and a binder; wherein the coupling component is an acylacetanilide represented by the formula (I):

(I)

wherein $R_1$ is substituted or unsubstituted alkyl or aryl; $R_2$ is substituted or unsubstituted alkyl or aralkyl; $R_3$ is substituted of unsubstituted alkyl, alkoxy, aralkyloxy, alkylthio, or aralkylthio, substituted amino, or halogeno; the total number of carbon atoms in $R_2$ and $(R_3)_n$ is 5 or more; n is zero or an integer of from 1 to 4; and the $R_3$'s may be the same or different when n is 2 or more, which is useful for forming a yellow color image and providing a developed color image with higher light-fastness, less soiling of a non-image area, and improved uniformity in color-developing layer due to the use of a more oil-soluble coupling component.

6 Claims, No Drawings

DIAZO HEAT-SENSITIVE RECORDING MATERIAL

This is a Continuation of application Ser. No. 07/798,586 filed Nov. 26, 1991, now abandoned.

FIELD OF THE INVENTION

The present invention relates to a diazo heat-sensitive recording material. More particularly, the present invention relates to a diazo heat-sensitive recording material which comprises a diazo compound, a coupling component, and a basic substance, and which is useful for forming a yellow color image.

BACKGROUND OF THE INVENTION

Recording materials for heat-sensitive recording generally are of a leuco color-development type. With this type of heat-sensitive recording material, an image is formed on the surface of the material through a color reaction caused by heat-fusion of either a leuco dye or an acidic substance dispersed in the heat-sensitive recording layer. This type of recording materials are disadvantageous in that fixation of the recorded image is insufficient and this results in undesired color development at a non-image areas on rough handling or heating, or by other causes, and in degrading the recorded image.

In recent years, diazo color-development type recording materials have been investigated extensively for the purpose of overcoming these disadvantages. For example, recording materials are described in which a recording layer contains color-developing components comprising a diazo compound, a coupling component, and a basic substance (including substances that becomes basic on heating) in JP-A-57-123086 (The term "JP-A" as used herein means an "unexamined published Japanese patent application".), *Gazou Denshi Gakkaishi* (Journal of Image Electronics Society), 11, 290 (1982), and so forth. With these recording materials, an image is firstly formed thereon by heating, and subsequently the material is irradiated with light to decompose the unreacted diazo compound to stop color development (namely, to fix the image).

However, even with recording materials utilizing a diazo compound, pre-coupling (or color reaction) slowly proceeds during storage before recording. This frequently causes undesired color development (or fogging).

Various improvements have been made to avoid undesired color-development. For example, one of the color-developing components is formed into discontinuous particles (or a solid dispersion), or is incorporated in a separate layer (JP-A-57-123086). These improvements attempt to keep one component separated from the other component to inhibit the pre-coupling reaction. Although satisfactory storability (so-called raw storability) is achieved with these improvements, heat-responsiveness (fusibility on heating), which is an important property, tends to be deteriorated.

Techniques for simultaneously improving the properties of raw storability and heat-responsiveness are known in which one of the color-developing components is encapsulated to separate it from the other component using a non-polar wax material (JP-A-57-44141 corresponding to U.S. Pat. No. 4,400,456, and JP-A-57-142636), or a hydrophobic polymer (JP-A-57-192944).

A wax material or a polymer material is dissolved in a suitable solvent in the above encapsulation, and a color-developing component or another component is dissolved or dispersed therein to form capsules. Accordingly the capsules in these methods are different in principle from usual capsules which are composed of a core material and a shell covering the core material. In capsules which are formed by dissolving a color-developing component, the color-developing component does not necessarily become the core material of the capsule but is mixed uniformly with the encapsulating substance. As a result, pre-coupling slowly proceeds at the wall interface, resulting in the disadvantage of insufficient raw storability. On the other hand, in capsules which are formed by dispersing a color-developing component, a color reaction occurs when the capsule wall is melted by heat. This results in the disadvantage of insufficient heat responsiveness. Furthermore, another problem in production is involved because the solvent used for dissolving or dispersing the wax substance or the polymer substance must be removed after the capsules have been formed.

Methods to offset these disadvantages are disclosed in which at least one of the components involved in the color reaction is incorporated in a core material of a microcapsule, and a wall is formed around the core material by polymerization to form microcapsules (JP-A-59-190886 corresponding to U.S. Pat. No. 4,650,740 and JP-A-60-6493).

On the other hand, acylacetoanilide type compounds, which are used widely as a coupling component for azo pigments with yellow to orange colors, are not necessarily satisfactory in terms of the light-fastness of the obtained images.

Known methods for increasing the light-fastness of images include addition of a discoloration-preventing agent or a UV-absorbing agent, improving fixation of the image to substrates, insolubilization in solvents (or pigment formation), and so forth.

The introduction of Cl, $OCH_3$, etc. into the aniline moiety of a coupling component is said to improve light-fastness. The compounds below are known therefor. Naphthol AS-LG (Color Index (CI) No. 37615):

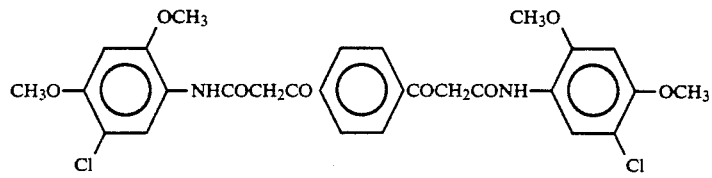

Naphthol AS-L3G:

-continued

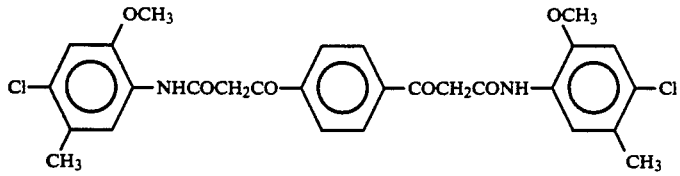

These compounds, however, have insufficient oil solubility. This results in disadvantages because a high concentration emulsion thereof cannot be prepared easily with the compound dissolved in a solvent or a plasticizer, and because a uniform and stable emulsion cannot readily be obtained because of deposition of the compound during storage.

Furthermore, the compound below is also known.

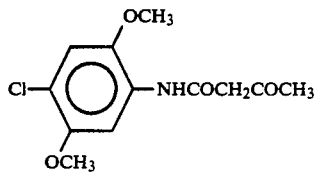

This compound, however, is slightly water-soluble because of its lower molecular weight although it is more soluble in a solvent. Therefore, a disadvantage occurs because this compound tends to undergo pre-coupling especially in the presence of a base.

Also, the following compounds are in the art.

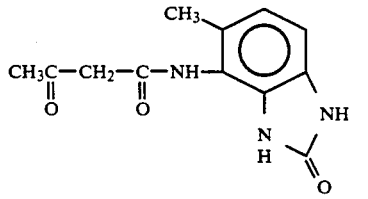

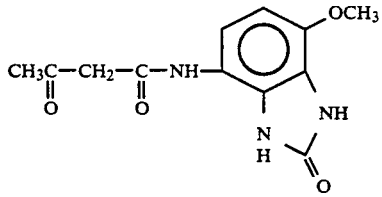

SUMMARY OF THE INVENTION

The present invention provides a diazo heat-sensitive recording material which provides higher light-fastness of the developed color image, less soiling of the non-image area, and improved uniformity of color-developing layer using a more oil-soluble coupling component.

The present invention provides a diazo heat-sensitive recording material which comprises a support having thereon a heat-sensitive recording layer comprising a diazo compound, a coupling component, a basic substance, and a binder; while the coupling component is an acylacetanilide represented by the general formula (I) below.

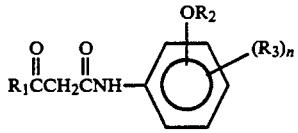

(I)

In the formula, $R_1$ is substituted or unsubstituted alkyl or aryl; $R_2$ is substituted or unsubstituted alkyl or aralkyl; $R_3$ is substituted or unsubstituted alkyl, alkoxy, aralkyloxy, alkylthio, or aralkylthio, substituted amino, or halogeno; the total number of carbon atoms in $R_2$ and $(R_3)_n$ is 5 or more; n is zero or an integer of from 1 to 4; and the $R_3$'s may be the same or different when n is 2 or more.

DETAILED DESCRIPTION OF THE INVENTION

After comprehensive study, it has been found that the use of the above-described coupling component provides a developed color image with high light-fastness and a stable heat-sensitive recording layer with less soiling of the non-image area.

In the compound of Formula (I), the total number of carbon atoms in $R_2$ and $(R_3)_n$ is preferably 5 or more, more preferably 8 or more, and is preferably 25 or less.

When $R_1$ is substituted or unsubstituted alkyl, the total number of carbon atoms therein is preferably from 1 to 20 and when $R_1$ is substituted or unsubstituted aryl, the total number of carbon atoms therein is preferably from 6 to 30. The total number of carbon atoms in $R_2$ is preferably from 1 to 15 and the total number of carbon atoms in $R_3$ is preferably from 1 to 15.

Examples of substituents which may substituted on $R_1$, $R_2$, and $R_3$ include alkyl, aryl, alkoxy, alkylthio, acyl, cyano, halogeno, ester, and amido, more preferably alkoxy, alkylthio, alkoxycarbonyl, alkylcarbonyloxy, alkylcarbonyl, cyano, and halogeno.

The compound of Formula (I) may be either an oil or crystals.

To prepare an emulsion, the compound may be dissolved in a suitable solvent such as tricresyl phosphate and dioctyl phthalate, or may be dissolved in a low-boiling solvent such as ethyl acetate as an auxiliary solvent.

The compound preferably has a suitable solubility in the aforementioned solvents, preferably a solubility of about 5% by weight or higher. The water solubility of the compound is preferably about 1% by weight or less.

The coupling component is preferably present in an amount of from about 0.05 to 5 $g/m^2$ in the heat-sensitive recording layer, more preferably in the range of from about 0.1 to 4 $g/m^2$ from the standpoint of color density developed.

The coupling component of the present invention can be easily synthesized by the conventional method, for example, by condensation of $\beta$-ketocarboxylic acid ester (e.g., pivaloylacetic acid ester and benzoylacetic acid ester), and an aniline derivative.

Specific examples of the compound are shown below but the invention is not to be construed to be limited to these examples in any way.
(A)
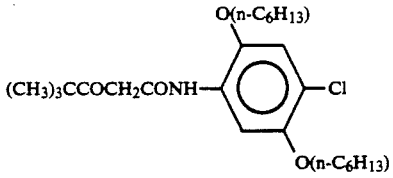
(B)
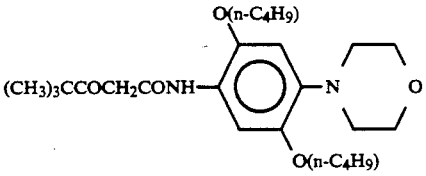
(C)
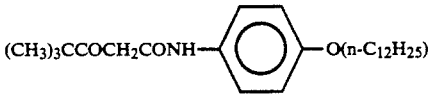
(D)
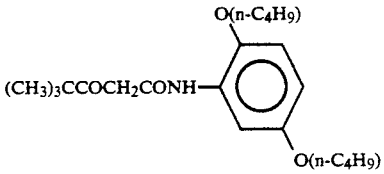
(E)
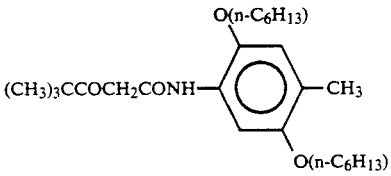
(F)
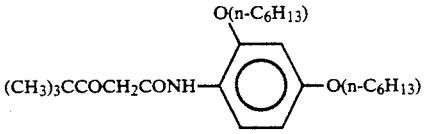
(G)
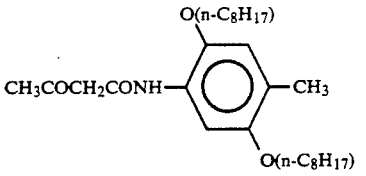
(H)
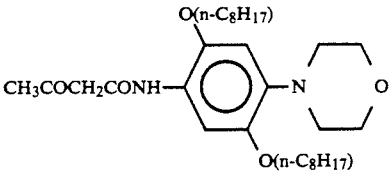
(I)
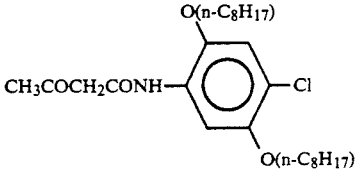
-continued
(J)
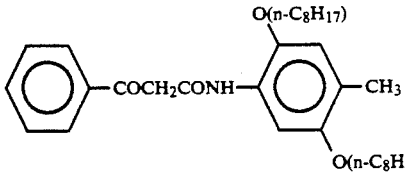
(K)
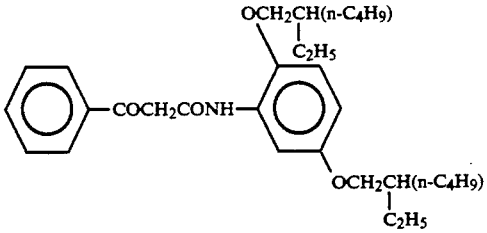
(L)
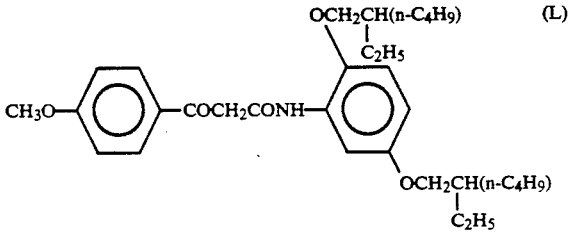
(M)
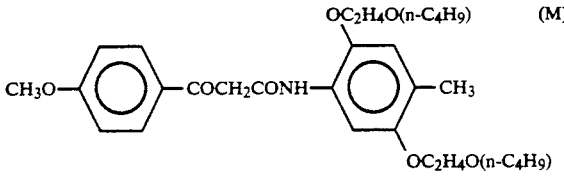
(N)
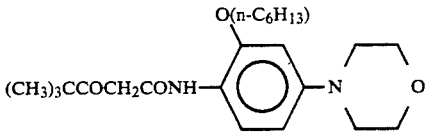
(O)
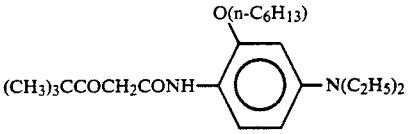
(P)
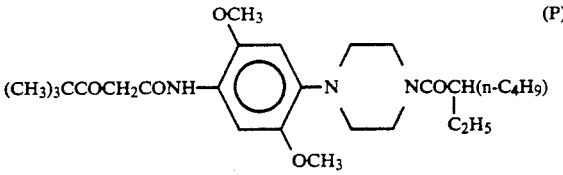
(Q)
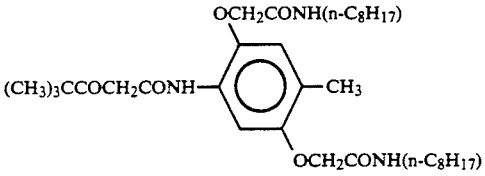
(R)
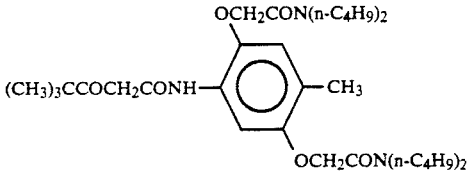

-continued (S)

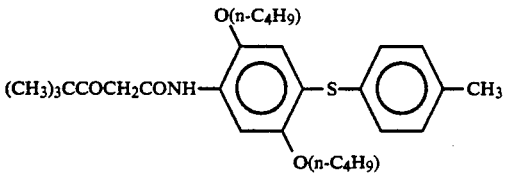

(T)

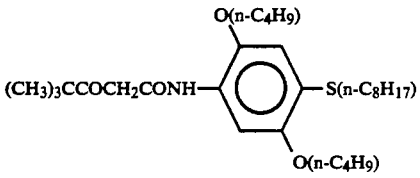

The coupling component of the present invention may be used alone or a combination of two or more thereof may be used. The combined use of two or more coupling components is preferable since deposition of the coupling component by aging is suppressed and thereby a stable and uniform heat-sensitive recording layer can be formed.

In addition, conventional coupling components may be used jointly with the coupling component of the present invention for the purposes of controlling proper hue and preventing deposit of the coupling component by aging.

The diazo compound to be used in the present invention may be any compound which is capable of developing color by reaction with the above-described coupling components in a basic environment.

Specific examples of suitable diazo compounds are shown below.

(1)

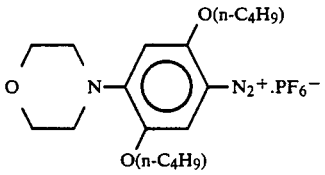

(2)

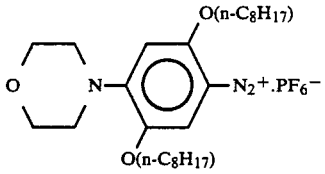

(3)

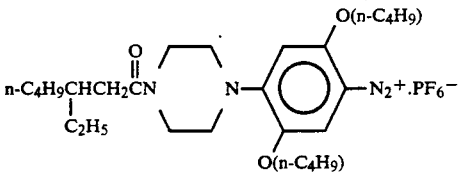

(4)

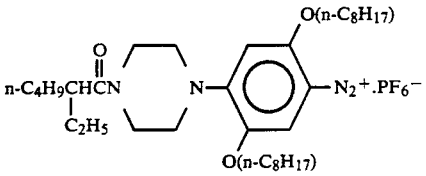

-continued (5)

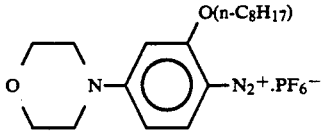

(6)

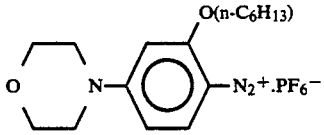

(7)

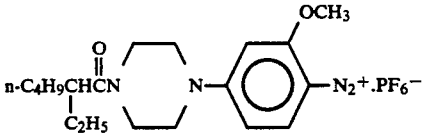

(8)

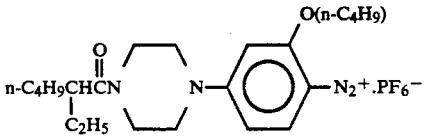

(9)

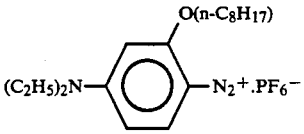

(10)

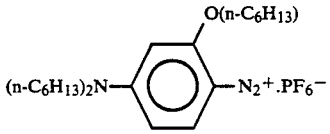

(11)

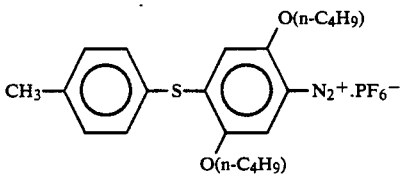

(12)

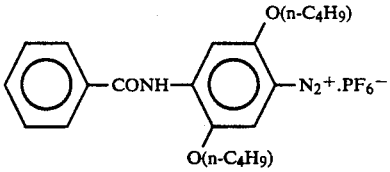

Preferable examples of acid anions include also $BF_4-$, $C_nF_{2n+1}CO_2-$, $C_mF_{2m+1}SO_3-$, $ZnCl_3-$, aromatic sulfonate ions, and the like in addition to $PF_6-$ shown above. These diazo compounds may be used alone or as a combination of two or more thereof if desired.

The diazo compound is present preferably in an amount of from about 0.01 to 5 g/m$^2$, more preferably from about 0.1 to 3 g/m$^2$.

The basic substance for forming a basic environment in the present invention may be selected arbitrarily from organic basic substances and the substances which generate alkali by heating. Specific examples thereof include ammonium acetate, tricyclohexylamine, tribenzylamine, octadecylbenzylamine, stearylamine, 2-benzylimidazole, 4-phenylimidazole, 2-phenyl-4-methylimidazole, 2-undecylimidazoline, 2,4,5-trifuryl-2-imidazoline, 1,2-diphenyl-4,4-dimethyl-2-imidazoline, 2-phenyl-2-imidazoline, 1,2,3-triphenylguanidine, 1,2-ditolylguanidine, 1,2-dicyclohexylguanidine, 1,2,3-tricyclohexylguanidine, guanidine trichloroacetate, N,N'-dibenzylpiperazine, 4,4'-dithiomorpholine, morpholinium trichloroacetate, 2-aminobenzothiazole, 2-benzoylhydrazino-benzothiazole, and the like. These compounds may be used alone or a combination of two or more thereof may be used depending on the purpose.

The basic substance is present preferably in an amount of from about 0.05 to 10 g/m$^2$, more preferably from about 0.1 to 5 g/m$^2$, Examples of binders which can be employed in the heat-sensitive recording layer include polyvinyl alcohol, methylcellulose, carboxymethylcellulose, hydroxypropylcellulose, gum arabic, gelatin, polyvinylpyrrolidone, casein, styrene-butadiene latex, acrylonitrile-butadiene latex, polyvinyl acetate, polyacrylate esters, ethylene-vinyl acetate copolymers, and the like. These compounds may be used in an emulsion form, if desired.

The binder is present in an amount of from about 0.5 to 5 g/m$^2$, on a solids basis.

The heat-sensitive recording layer may be formed by mixing a diazo compound, a coupling component, a basic substance, a binder, and a suitable solvent; dispersing the mixture using an attritor, a sand mill, or the like to prepare a coating liquid; applying the coating liquid on a support using bar coating, blade coating, air-knife coating, gravure coating, roll coating, spray coating, immersion coating, or the like; and drying the coating.

The diazo compound may be enclosed in microcapsules. Micro-capsulation is preferable since the diazo compound is separated more completely from the coupling component, with the tendency toward pre-coupling being reduced.

The microcapsules may be formed using known methods, one of which is described briefly below (cf., U.S. Pat. No. 3,726,804 and U.S. Pat. No. 3,796,669, etc.)

Firstly, the diazo compound is dissolved or dispersed in a suitable organic solvent. This solution or dispersion (an oily liquid) is emulsified in an aqueous medium.

The examples of suitable organic solvent are phosphoric acid esters, phthalic acid esters, carboxylic acid esters, fatty acid amides, alkylated biphenyls, alkylated terphenyls, chlorinated paraffins, alkylated naphthalenes, carbonic acid esters, diarylethanes, and the like.

Then, a wall of a polymer material is formed around the emulsified oil droplet. The reactant for formation of the polymeric material is added to the oily liquid and/or the aqueous medium.

The polymer material for forming the capsule wall must be impermeable at ordinary temperature but must become permeable on heating, and preferably has a glass transition temperature of from about 60° to 200° C. Suitable examples of polymer materials include polyurethanes, polyureas, polyamides, polyesters, urea-formaldehyde resins, melamine resins, polystyrenes, styrene-methacrylate copolymers, styrene-acrylate copolymers, and mixtures of these polymers.

The microcapsules can be formed by interfacial polymerization and one of the in situ polymerization methods that the polymerizable monomer (core material contains the monomer) is supplied from the internal of the capsule (cf., Asaji Kondoh, *Microcapsule*, p. 48 (1970)).

The detail of capsule formation methods and the specific examples of the reactants are described in U.S. Pat. No. 3,726,804 and U.S. Pat. No. 3,796,669. As an example, where a polyureapolyurethane is used as the capsule wall material, a polyisocyanate and a second material (e.g., a polyol, a polyamine, etc.) capable of reacting with the isocyanate to form a capsule wall are mixed in an aqueous medium or an oily liquid to be encapsulated, and the mixture is emulsified in water. The mixture is subsequently heated to cause a polymer-forming reaction at the interface of the oil droplets to form microcapsule walls. If desired, an auxiliary solvent having a low boiling point and a high dissolving power may be added to the oily liquid. Even if the addition of the second material is omitted, polyurea will be formed.

In the formation of the microcapsule, a water-soluble polymer may be used as a protective colloid. Examples of suitable water-soluble polymers include anionic polymers, nonionic polymers, and amphoteric polymers which are water-soluble.

The water-soluble polymer is used as an aqueous solution at a concentration of from about 0.01 to 10% by weight.

Other components which improve the heat-recording density may be added to the binder solution in formation of the heat-sensitive recording layer. Specifically, compounds which have a melting point in the range of from about 50° to 150° C., preferably from about 90° to 130° C., and are compatible with the diazo compound, the coupling component, and the basic substance can be added. Suitable compounds include fatty acid amides, ketones, ethers, urea compounds, esters, and the like. These compounds are usually employed in the form of dispersed particles of a size of from about 1 to 10 μm and in a solid amount of from about 0.2 to 7 g/m$^2$.

A fine powder of a pigment such as kaolin, talc, silica, barium sulfate, titanium dioxide, aluminum hydroxide, zinc oxide, and calcium carbonate; styrene beads, or a ureamelamine resin may be added to prevent adhesion of the recording layer to a thermal head and to improve writing property. Similarly, a metal soap may be employed to prevent adhesion. Such additives are usually added in an amount of from about 0.2 to 7 g/m$^2$.

Citric acid, tartaric acid, oxalic acid, boric acid, phosphoric acid may be added in addition to the above additive.

The recording layer formed usually has a solid content of from about 2.5 to 25 g/m$^2$.

The support employed in the present invention may be selected from the materials known as supports for heat-sensitive materials, such as wood-free paper, synthetic paper, and synthetic resin films, in accordance with the use thereof. Papers which can be used for the support include neutral paper sized with a neutral sizing agent such as an alkylketene dimer and having a heat-extraction pH value in the range of from 6 to 9 and are preferable because of long-term storability (described in JP-A-55-14281 corresponding to U.S. Pat. No. 4,255,491). Other examples are the papers described in JP-A-57-116687 corresponding to U.S. Pat. No. 4,416,939, JP-A-58-136492, JP-A-58-69091 corresponding to U.S. Pat. No. 4,490,732, JP-A-58-65695 corresponding to U.S. Pat. No. 4,466,007, and JP-A-59-35985 corresponding to U.S. Pat. No. 4,576,831.

Mainly, either of the following two methods may be employed for the formation of an image on the recording material of the present invention. One method comprises forming an image by causing a color-developing reaction in the recording layer by means of heating with a hot plate, a thermal head, or the like and subsequently irradiating the non-heated area (the area other than the image portion) using a light source capable of decomposing the diazo compound to thereby decompose the diazo compound (fixation). Another method comprises irradiating the recording material through a transparent or semi-transparent original using a light source capable of decomposing the diazo compound to thereby decompose the diazo compound in the area other than the image area of the original (the area other than the image area is fixed and a latent image of the diazo compound is formed according to the image of the original) and subsequently heating the latent image area (only the latent image area or whole of the recording material may be heated) to thereby cause a color-developing reaction to form an image.

The examples of the present invention and comparative examples are described below without limiting the invention. The term "part" in the examples and the comparative examples are parts by weight, unless otherwise indicated.

EXAMPLE 1

(i) A core substance solution was prepared by mixing and dissolving 3.5 parts of 4-morpholino-2,5-dibutoxybenzenediazonium hexafluorophosphate, 9 parts of tricresyl phosphate, 20 parts of ethyl acetate, 4 parts of trimethylolpropane trimethacrylate, and 10 parts of Takenate D-110N (1:1 adduct of trimethylolpropane and xylylenediisocyanate; made by Takeda Chemical Industries, Ltd.).

This solution was added to 65 parts of an aqueous polyvinyl alcohol solution (8% by weight), and emulsified at 20° C. to obtain a liquid emulsion with an average particle diameter of 1 μm. This liquid emulsion was allowed to react at 60° C. for 2 hours to obtain a microcapsule liquid.

(ii) Seven parts of 4,4-dimethyl-3-oxopentanoic acid 2',5'-di-n-hexyloxy-4'-chloroanilide (Compound (A)), 3.5 parts of triphenylguanidine, 3.5 parts of 1,1-bis (4-hydroxyphenyl)-2-ethylhexane, 1 part of tricresyl phosphate, and 0.5 part of dimethyl maleate were dissolved in 35 parts of ethyl acetate at 40° C. to prepare a uniform solution. This solution was added to 60 parts of an aqueous polyvinyl alcohol solution (5% by weight). The mixture was emulsified using a homogenizer to obtain a coupling component liquid solution having an average particle size of 0.5 μm.

(iii) A coating liquid was prepared by mixing 30 parts of the microcapsule liquid produced in (i) above and 18 parts of the coupling component liquid emulsion produced in (ii) above.

(iv) This coating solution was applied on a surface of a transparent smooth polyethylene terephthalate film (coating amount: 50 g/m$^2$). The coated layer was dried at 40° C. for 30 minutes to prepare a heat-sensitive recording sheet with a heat-sensitive recording layer of a dry weight of 5 g/m$^2$.

EXAMPLE 2

A heat-sensitive recording sheet was prepared in the same manner as in Example 1 except that 4,4-dimethyl-3-oxopentanoic acid 2',5'-di-n-butoxy-4'-morpholinoanilide (Compound (B)) was used as the coupling component.

EXAMPLE 3

A heat-sensitive recording sheet was prepared in the same manner as in Example 1 except that 4-tolylthio-2,5-dibutoxybenzenediazonium hexafluorophosphate was used as the diazo compound, and the coupling component of Example 2 was used.

COMPARATIVE EXAMPLE 1

Naphthol AS-LG (C.I. No. 37615) was used as the coupling component. An emulsion could not be obtained due to the only slight solubility of this coupling component in ethyl acetate.

COMPARATIVE EXAMPLE 2

A heat-sensitive recording sheet was prepared in the same manner as in Example 1 except that 4-chloro-2,5-dibutoxyacetoacetanilide was used as the coupling component.

COMPARATIVE EXAMPLE 3

A heat-sensitive recording sheet was prepared in the same manner as in Example 1 except that 4,4-dimethyl-3-oxopentanoic acid 2'-chloro-5'-octyloxycarbonylanilide was used as the coupling component.

A smooth heat-sensitive recording layer was formed in Examples 1 to 3 and Comparative Examples 2 to 3.

The resulting heat-sensitive recording sheets were imagewise exposed and subjected to color development by using a hot plate. A yellow image was formed in the sheets.

The light-fastness of the formed image was tested.

The testing was conducted under conditions of illumination with a fluorescent lamp of 32,000 lux for 16 hours.

The change of the color density was measured using a MacBeth reflectodensitometer (made by MacBeth Co.).

The results obtained are shown in Table 1 below.

TABLE 1

| | Before Illumination | | After Illumination | |
|---|---|---|---|---|
| | Image Area | (Non-Image Area) | Image Area | (Non-Image Area) |
| Example 1 | 1.35 | (0.24) | 1.28 | (0.19) |
| Example 2 | 1.31 | (0.22) | 1.30 | (0.23) |
| Example 3 | 1.26 | (0.24) | 1.25 | (0.22) |
| Comparative Example 2 | 1.32 | (0.45) | 1.39 | (0.52) |
| Comparative Example 3 | 1.35 | (0.22) | 0.76 | (0.16) |

From the results shown above, it is obvious that the coupling component of the present invention forms a stable emulsion, and that the resulting heat-sensitive recording material has a formed image with high light-fastness and less soiling of non-image areas.

While the invention has been described in detail and with reference to specific embodiments thereof, it will be apparent to one skilled in the art that the various changes and modifications can be made therein without departing from the spirit and scope thereof.

What is claimed is:

1. A diazo heat-sensitive recording material which consists essentially of a support having thereon a heat-sensitive recording layer comprising a diazo compound, a coupling component, a basic substance, and a binder; wherein said coupling component is an acylacetanilide represented by the formula (I):

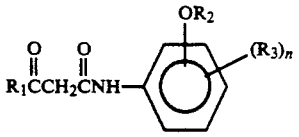

(I)

wherein $R_1$ is $C(CH_3)_3$; $R_2$ is substituted or unsubstituted alkyl or aralkyl; $R_3$ is substituted or unsubstituted alkyl, alkoxy, aralkyloxy, alkylthio, or aralkylthio, substituted amino, or halogeno; the total number of carbon atoms in $R_2$ and $(R_3)_n$ is 8 or more; n is zero or an integer of from 1 to 4; and the $R_3$—s may be the same or different when n is 2 or more.

2. The diazo heat-sensitive recording material of claim 1, wherein the total number of carbon atoms in $R_2$ is from 1 to 15.

3. The diazo heat-sensitive recording material of claim 1, wherein the total number of carbon atoms in $R_3$ is from 1 to 15.

4. The diazo heat-sensitive recording material of claim 1, wherein said coupling component is present in said recording material in an amount of from 0.05 to 5 $g/m^2$.

5. The diazo heat-sensitive recording material of claim 1, wherein said diazo compound is emulsified in an aqueous medium.

6. The diazo heat-sensitive recording medium of claim 1, wherein said diazo compound is enclosed is microcapsules.

* * * * *